US009937986B1

(12) United States Patent
Oh et al.

(10) Patent No.: US 9,937,986 B1
(45) Date of Patent: Apr. 10, 2018

(54) MULTI-JOINT FISH ROBOT CAPABLE OF RAPID ACCELERATION PROPULSION

(71) Applicant: AIRO Inc., Suncheon-si, Jeollanam-do (KR)

(72) Inventors: Yong Ju Oh, Suwon-si (KR); Young Tae Joo, Gwangyang-si (KR)

(73) Assignee: AIRO Inc., Suncheon-si, Jeollanam-do (KR)

( * ) Notice: Subject to any disclaimer, the term of this patent is extended or adjusted under 35 U.S.C. 154(b) by 0 days.

(21) Appl. No.: 15/450,035

(22) Filed: Mar. 6, 2017

(30) Foreign Application Priority Data

Nov. 10, 2016 (KR) ..... 10-2016-0149739

(51) Int. Cl.

| | |
|---|---|
| ***B63G 8/00*** | (2006.01) |
| ***B63G 8/08*** | (2006.01) |
| ***B63H 1/36*** | (2006.01) |
| ***B63G 8/04*** | (2006.01) |

(52) U.S. Cl.
CPC ..... *B63G 8/001* (2013.01); *B63G 8/04* (2013.01); *B63G 8/08* (2013.01); *B63H 1/36* (2013.01); *B63G 2008/002* (2013.01)

(58) Field of Classification Search
CPC . B63H 1/00; B63H 1/36; B63H 11/00; B63G 8/08; B63G 8/18; A63H 23/00; A63H 23/10
USPC ..... 114/332, 337; 440/15
See application file for complete search history.

(56) References Cited

U.S. PATENT DOCUMENTS

| | | | | |
|---|---|---|---|---|
| 3,783,552 A * | 1/1974 | Goldbach | A63H 23/10 446/158 |
| 6,138,604 A * | 10/2000 | Anderson | B63G 8/08 114/332 |
| 6,835,108 B1 * | 12/2004 | Gieseke | B63H 1/36 440/14 |
| 7,865,268 B2 * | 1/2011 | Valdivia y Alvarado | A01K 85/01 114/332 |
| 9,090,320 B2 * | 7/2015 | Rufo | B63H 1/36 |

FOREIGN PATENT DOCUMENTS

| | | | |
|---|---|---|---|
| JP | 2008-044545 | A | 2/2008 |
| JP | 2011-063222 | A | 3/2011 |
| KR | 10-1094789 | B1 | 12/2011 |
| KR | 10-2012-0077458 | A | 7/2012 |
| KR | 10-1385222 | B1 | 4/2014 |

* cited by examiner

*Primary Examiner* — Lars A Olson
(74) *Attorney, Agent, or Firm* — Revolution IP, PLLC

(57) ABSTRACT

A multi-joint fish robot capable of rapid acceleration propulsion, including: a main body segmented into a first body, a second body and a third body; joints connecting the respective bodies; and a caudal fin provided at an end portion of a third body, and swims forming a curve by operations of the joints. The fish robot has a first occupancy ratio of a length of the caudal fin to a full length of the fish robot with respect to a swimming direction, in which the fish robot swims, and the first occupancy ratio ranges from 0.15 to 0.35, or the fish robot has a second occupancy ratio of a length of the first body to a length of the main body excluding the caudal fin with respect to a swimming direction, in which the fish robot swims, and the first occupancy ratio ranges from 0.45 to 0.75.

18 Claims, 12 Drawing Sheets

MULTI-JOINT FISH ROBOT CAPABLE OF RAPID ACCELERATION PROPULSION

CROSS-REFERENCE TO RELATED APPLICATION

This application claims priority to Korean Patent Application No. 10-2016-0149739, filed on Nov. 10, 2016 at the Korean Intellectual Property Office, the disclosure of which is incorporated herein by reference.

BACKGROUND

The present invention relates to a multi-joint fish robot capable of rapid acceleration propulsion, and more particularly to a multi-joint fish robot capable of rapid acceleration propulsion, which is improved in swimming speed of the fish robot by making length ratios of parts of the fish robot be set within a predetermined range.

In general, technology of robots used in underwater environment has been perceived as one of very important tools that can most actively cope with change in human life for the $21^{st}$ century and surpass this change.

Development of the robots for the underwater environment puts emphasis on development of special-purpose robots for developing and exploring seabed resources with rapid increase in demand of resource development due to high oil prices, and is thus focused on pressure-resistant design and waterproof function in deep sea.

With recent interest and study of the underwater robot, motion imitation of nature living things has been actively researched to overcome a limitation of a conventional robot driving mechanism. In particular, research on a fish robot of copying a motion of a fish has attracted attention.

A swimming mechanism of the fish robot, which is efficiently movable overcoming limitations of a conventional propulsion mechanism using a propeller, is more excellent in performance and efficiency than that of any man-made one since fins are effectively controlled. Actually, a propeller-type propulsion mechanism of an underwater moving body has a relatively low efficiency of 50%-55% since there are limitations due to fluid resistance, but it has been known that the swimming mechanism of the fish robot has an efficiency of 60%-70% higher than the general propeller-type propulsion mechanism by 20% or more.

Recently, there has been developed a fish robot capable of monitoring quality of river water including four major rivers. However, as a test result of under an actual underwater environment, the fish robot has showed just a swimming speed of 0.23 m per second, which is slower than even one-$10^{th}$ of a required target value of 2.5 m per second.

Thereafter, to improve the swimming speed of the fish robot, the fish robot has been various studied to develop a material, design a swimming mechanism, improve joint flexibility, etc.

PRIOR ART DOCUMENTATION

Patent Documentation

Korean Patent No. 10-1094789 (registered on 2011 Dec. 16 and titled "Fish Type Robot and the Swimming Controlling Method thereof").

SUMMARY

Accordingly, the present invention is conceived to solve the conventional problems, and an aspect of the present invention is to provide a multi-joint fish robot capable of rapid acceleration propulsion, which can maximize propulsion with respect to a swimming direction of the fish robot, and minimize water resistance, thereby improving swimming speed and energy efficiency.

In accordance with an embodiment of the present invention, there is provided a multi-joint fish robot capable of rapid acceleration propulsion, which comprises a main body segmented into a first body, a second body and a third body; joints connecting the respective bodies; and a caudal fin provided at an end portion of the third body, and swims forming a curve by operations of the joints, wherein the fish robot has a first occupancy ratio of a length of the caudal fin to a full length of the fish robot with respect to a swimming direction, in which the fish robot swims, and the first occupancy ratio ranges from 0.15 to 0.35.

In accordance with another embodiment of the present invention, there is provided a multi-joint fish robot capable of rapid acceleration propulsion, which comprises a main body segmented into a first body, a second body and a third body; and joints connecting the respective bodies, and swims forming a curve by operations of the joints, wherein the fish robot has a second occupancy ratio of a length of the first body to a length of the main body with respect to a swimming direction, in which the fish robot swims, and the second occupancy ratio ranges from 0.45 to 0.75.

In the multi-joint fish robot capable of the rapid acceleration propulsion, a third occupancy ratio of a length of the second body to a length of a rear half body occupied by the second body and the third body may range from 0.5 to 0.75.

In the multi-joint fish robot capable of the rapid acceleration propulsion, a first cross-sectional ratio of a cross-sectional width of the first body to a first cross-sectional width of the second body facing a cross-section of the first body with respect to a widthwise direction perpendicular to the swimming direction may range from 0.9 to 1.25.

In the multi-joint fish robot capable of the rapid acceleration propulsion, a second cross-sectional ratio of a second cross-sectional width of the second body to a cross-sectional width of the third body facing a second cross-section of the second body with respect to a widthwise direction perpendicular to the swimming direction may range from 0.9 to 1.25.

In the multi-joint fish robot capable of the rapid acceleration propulsion, the first body and the second body may be spaced apart from each other by a first distance, and an edge of a first cross-section of the second body facing the first body may be chamfered or rounded.

In the multi-joint fish robot capable of the rapid acceleration propulsion, the edge of the cross-section of the second body may be formed with a first chamfered area, a first stepped distance between a first slope starting point at which the cross-section of the second body meets with the first chamfered area and a virtual first intersection line on which the cross-section of the second body is extended and meets with an outer surface of the second body may be equal to or longer than the first distance, and an angle of the first chamfered area to the swimming direction may range from 25° to 45°.

In the multi-joint fish robot capable of the rapid acceleration propulsion, if the cross-sectional width of the first body is larger than the first cross-sectional width of the second body facing the first body, the first stepped distance may be equal to the first distance, and if the cross-sectional width of the first body is smaller than the first cross-sectional width of the second body, the first stepped distance may be twice the first distance.

In the multi-joint fish robot capable of the rapid acceleration propulsion, the second body and the third body may be spaced apart from each other by a second distance, and an edge of a cross-section of the third body facing the second body may be chamfered or rounded.

In the multi-joint fish robot capable of the rapid acceleration propulsion, the edge of the cross-section of the third body may be formed with a second chamfered area, a second stepped distance between a second slope starting point at which the cross-section of the third body meets with the second chamfered area and a virtual second intersection line on which the cross-section of the third body is extended and meets with an outer surface of the third body may be equal to or longer than the second distance, and an angle of the first chamfered area to the swimming direction may range from 25° to 45°.

In the multi-joint fish robot capable of the rapid acceleration propulsion, if the second cross-sectional width of the second body is larger than the cross-sectional width of the third body facing a second cross-section of the second body, the second stepped distance may be equal to the second distance, and if the second cross-sectional width of the second body is smaller than the cross-sectional width of the third body, the second stepped distance may be twice the second distance.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION

Hereinafter, embodiments of a multi-joint fish robot capable of a rapid acceleration propulsion according to the present invention will be described with reference to the accompanying drawings.

Figure 1:
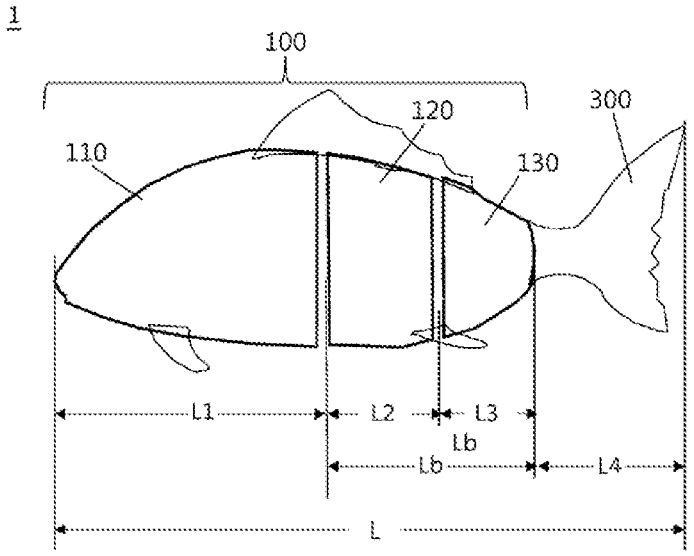
FIG. 1 is a lateral view of a multi-joint fish robot capable of rapid acceleration propulsion according to an embodiment of the present invention.
Figure 2:
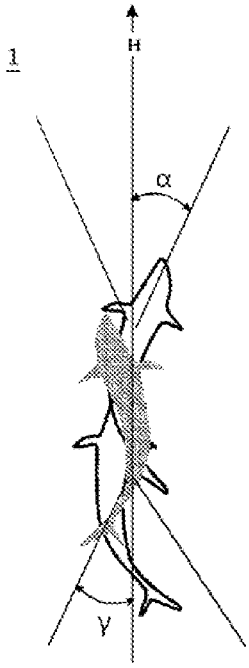
FIG. 2 is a view for explaining a swimming pattern of the multi-joint fish robot capable of the rapid acceleration propulsion of FIG. 1.
Figure 3:
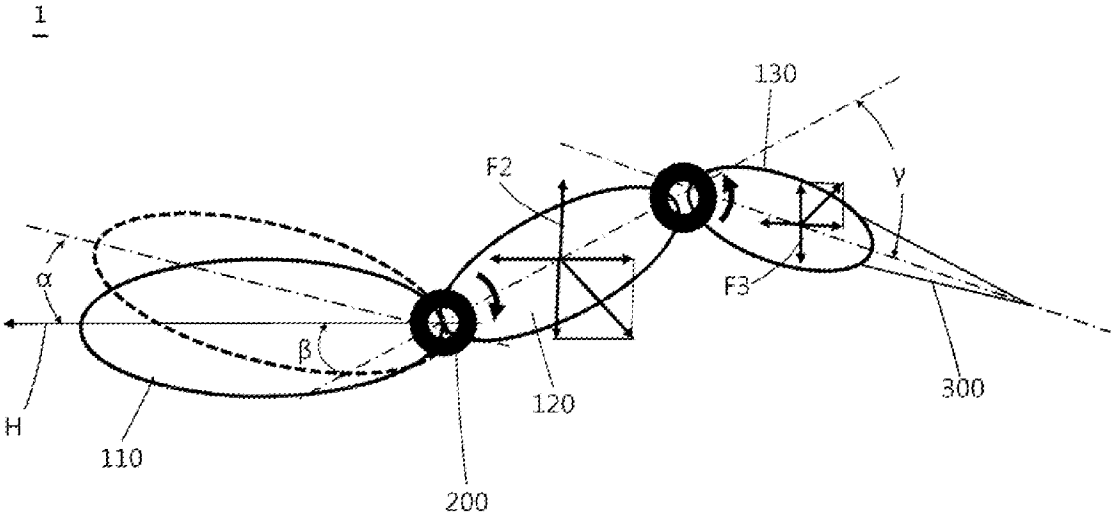
FIG. 3 is a view for explaining a principle of generating the propulsion in the multi-joint fish robot capable of the rapid acceleration propulsion of FIG. 1.
Figure 4:
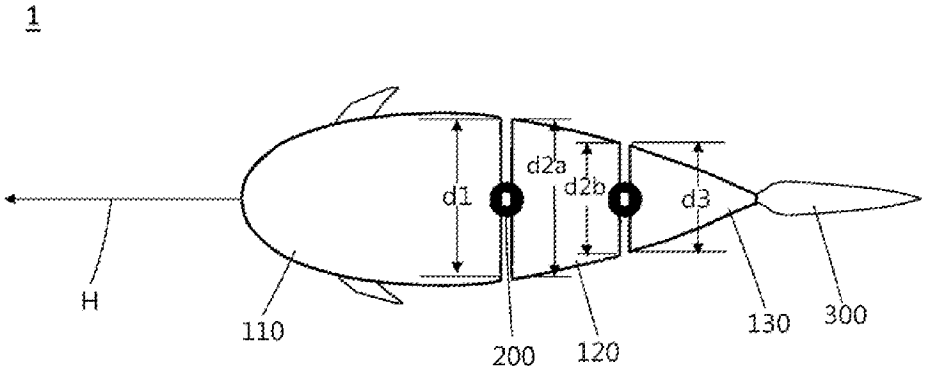
FIG. 4 is a plan view of the multi-joint fish robot capable of the rapid acceleration propulsion of FIG. 1.
Figure 5:
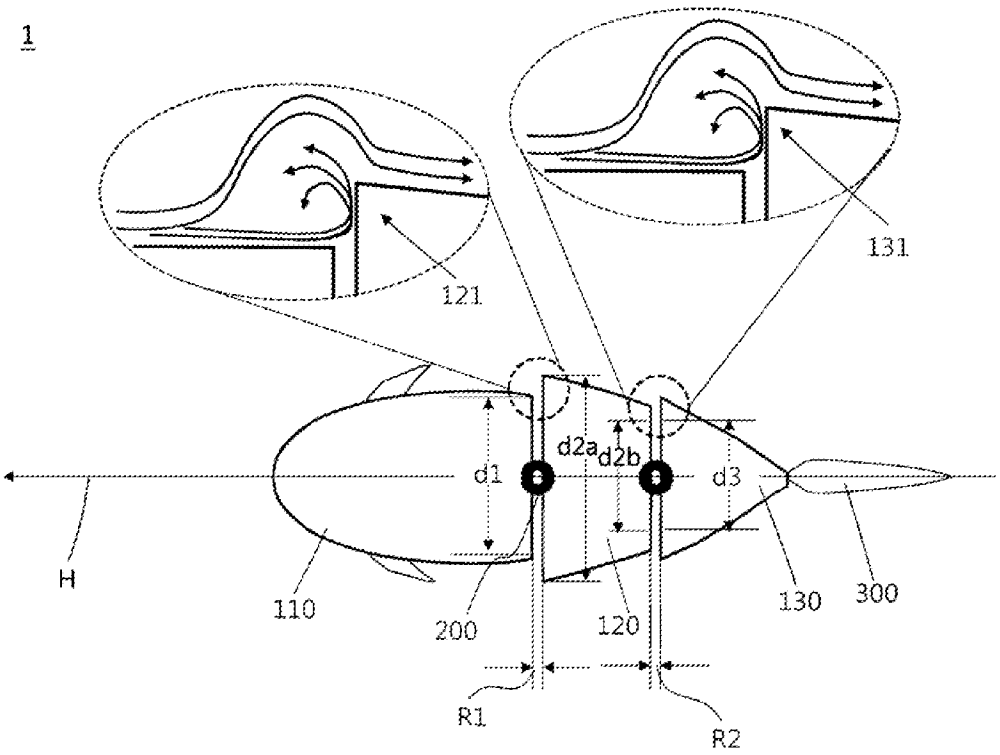
FIG. 5 is a view for explaining a form of vortexes generated at joints in the multi-joint fish robot capable of the rapid acceleration propulsion of FIG. 4.
Figure 6:
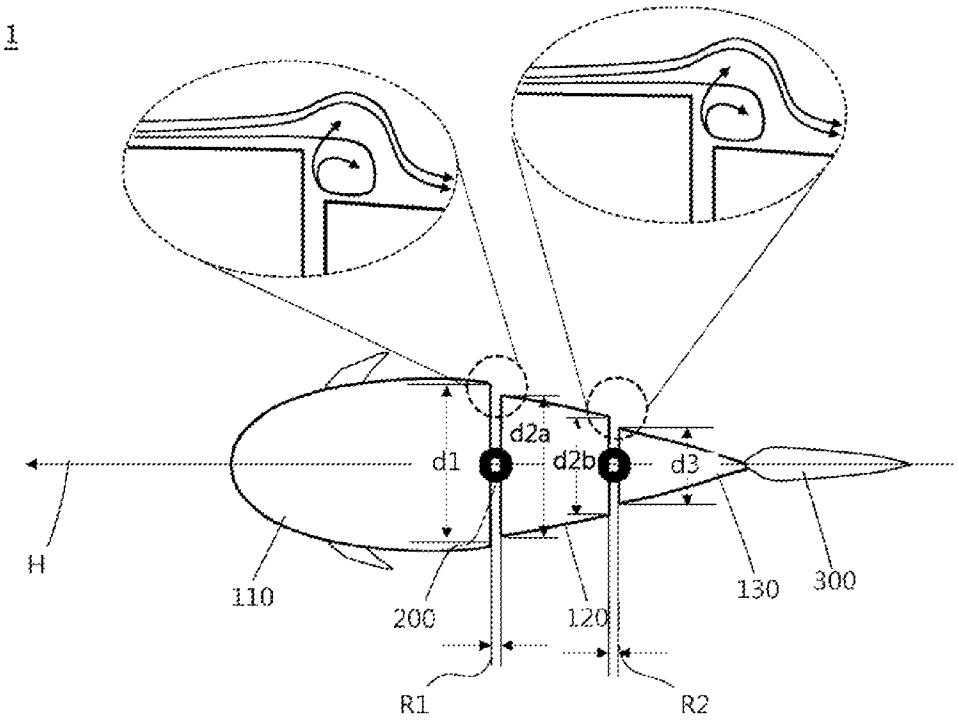
FIG. 6 is a view for explaining another form of vortexes generated at joints in the multi-joint fish robot capable of the rapid acceleration propulsion of FIG. 4.
Figure 7:
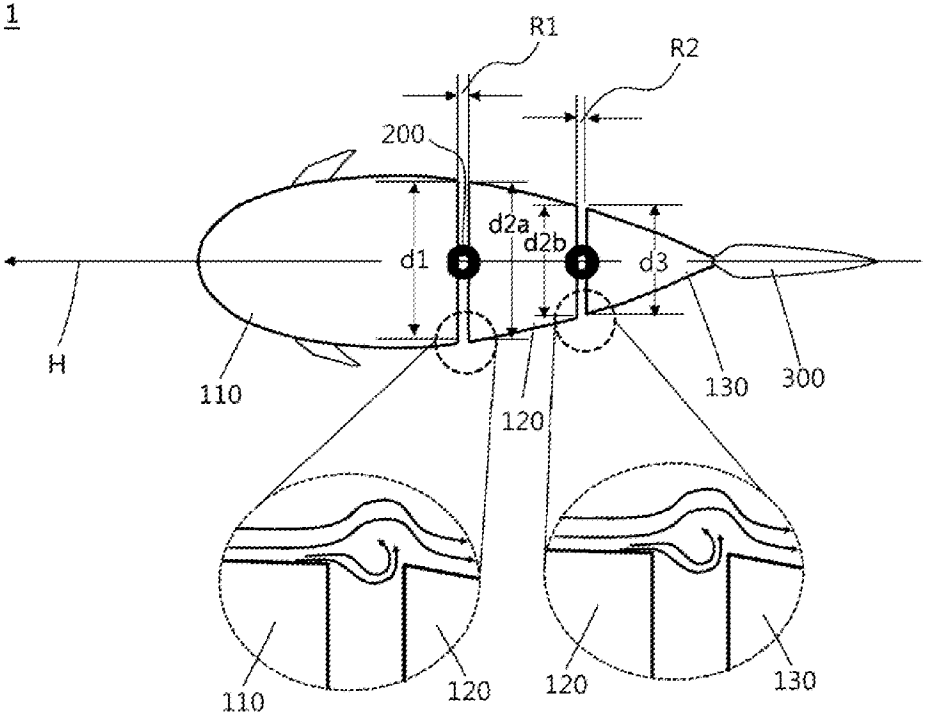
FIG. 7 is a view for explaining still another form of vortexes generated at joints in the multi-joint fish robot capable of the rapid acceleration propulsion of FIG. 4.
Figure 8:
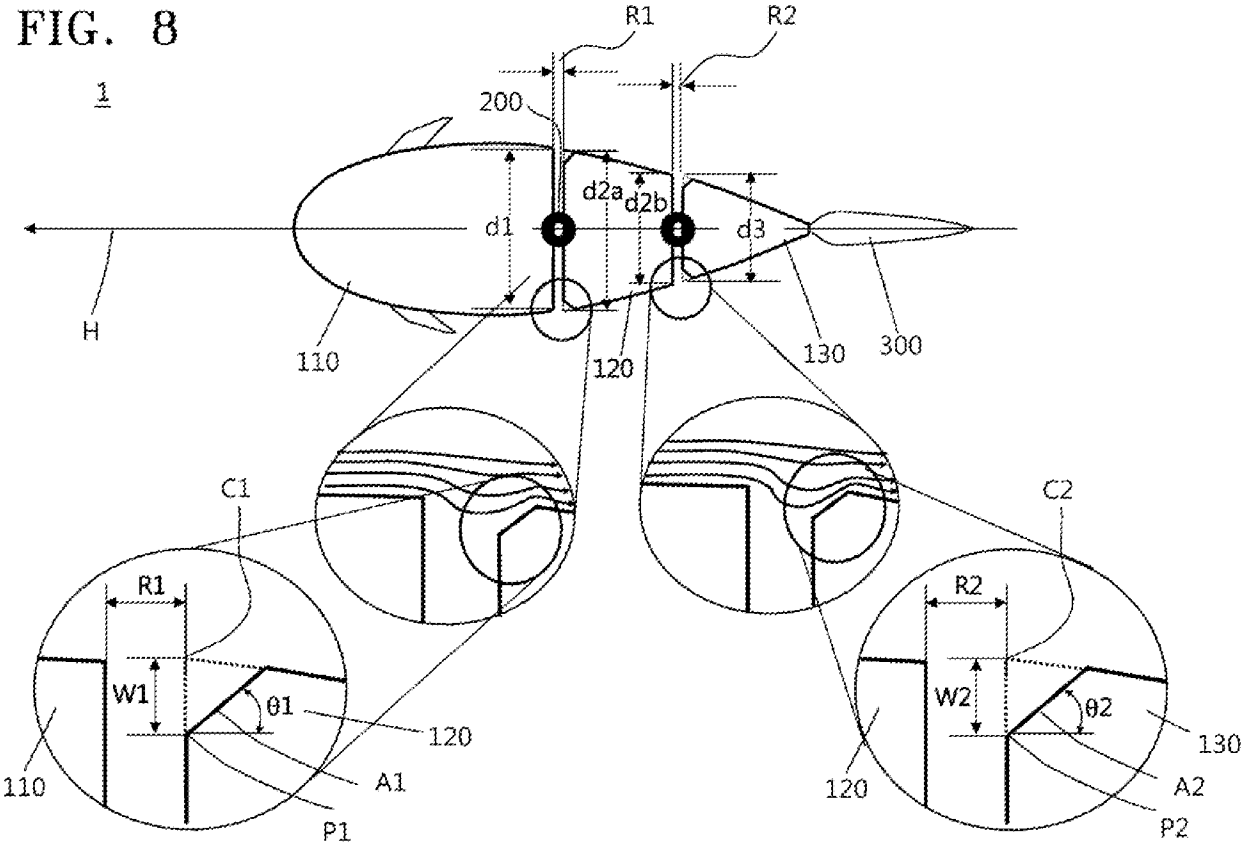
FIG. 8 is a view of showing chamfered edges of second and third bodies in the multi-joint fish robot capable of the rapid acceleration propulsion of FIG. 7.
Figure 9:
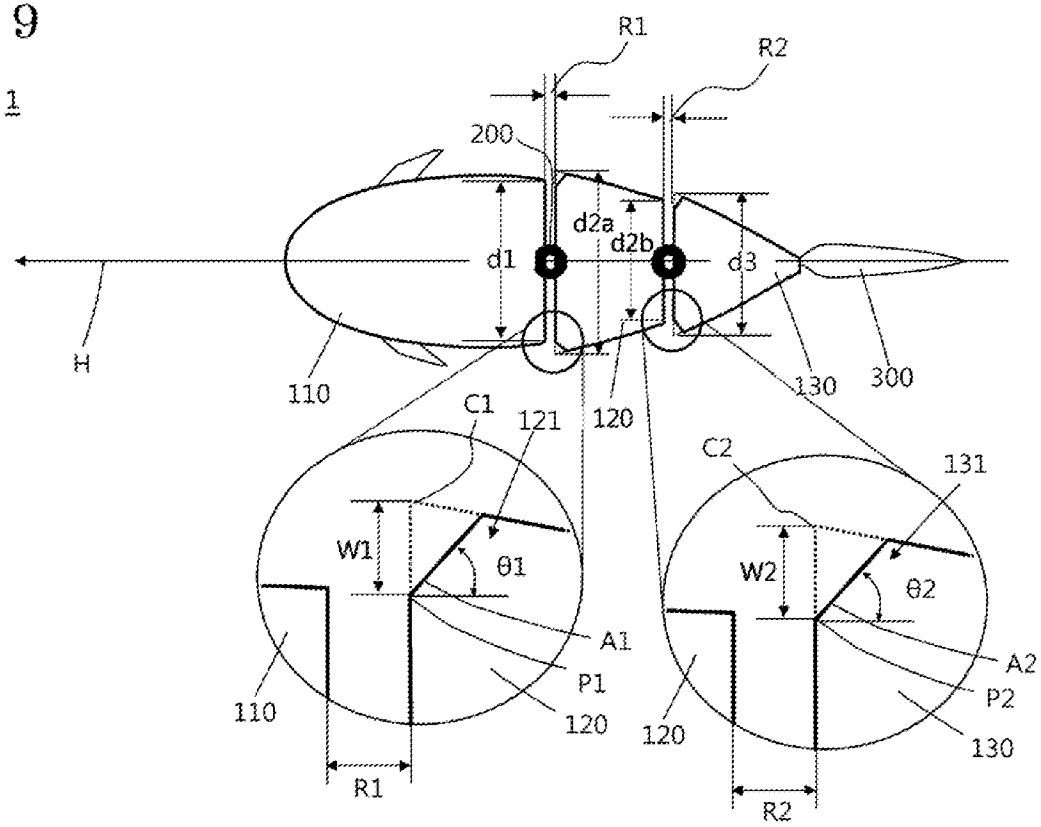
FIG. 9 is a view of showing chamfered edges of second and third bodies in the multi-joint fish robot capable of the rapid acceleration propulsion of FIG. 5.
Figure 10:
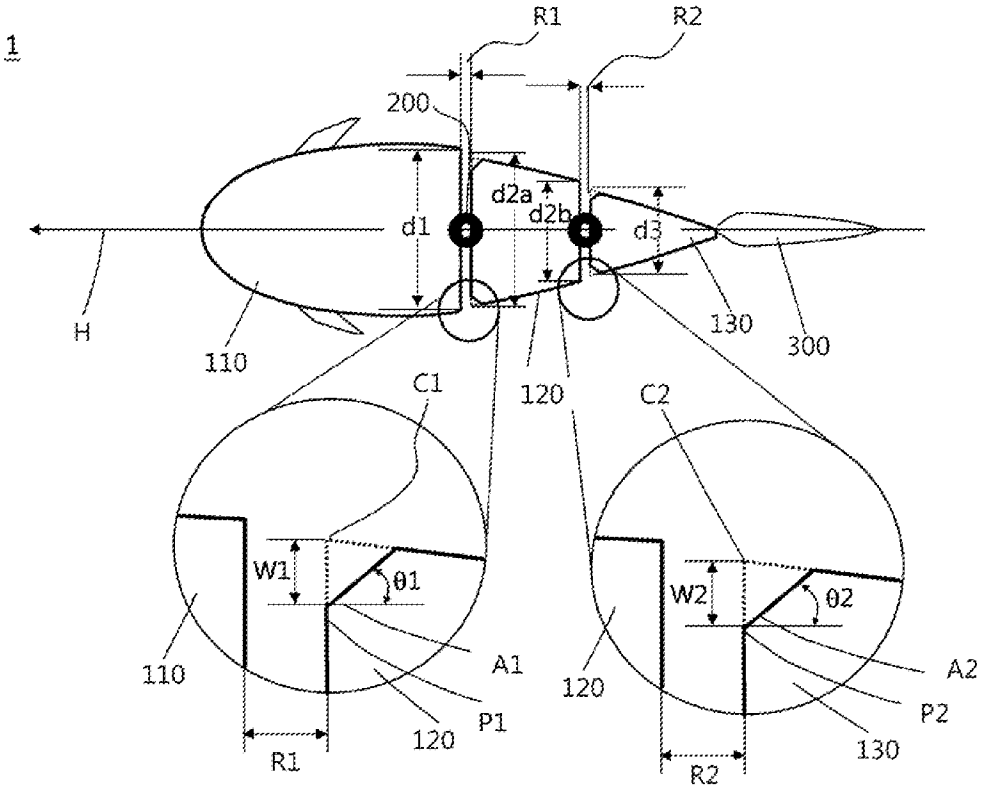
FIG. 10 is a view of showing chamfered edges of second and third bodies in the multi-joint fish robot capable of the rapid acceleration propulsion of FIG. 6.

FIG. 1 is a lateral view of a multi-joint fish robot capable of rapid acceleration propulsion according to an embodiment of the present invention, FIG. 2 is a view for explaining a swimming pattern of the multi-joint fish robot capable of the rapid acceleration propulsion of FIG. 1, FIG. 3 is a view for explaining a principle of generating the propulsion in the multi-joint fish robot capable of the rapid acceleration propulsion of FIG. 1, FIG. 4 is a plan view of the multi-joint fish robot capable of the rapid acceleration propulsion of FIG. 1, FIG. 5 is a view for explaining a form of vortexes generated at joints in the multi-joint fish robot capable of the rapid acceleration propulsion of FIG. 4, FIG. 6 is a view for explaining another form of vortexes generated at joints in the multi-joint fish robot capable of the rapid acceleration propulsion of FIG. 4, FIG. 7 is a view for explaining still another form of vortexes generated at joints in the multi-joint fish robot capable of the rapid acceleration propulsion of FIG. 4, FIG. 8 is a view of showing chamfered edges of second and third bodies in the multi-joint fish robot capable of the rapid acceleration propulsion of FIG. 7, FIG. 9 is a view of showing chamfered edges of second and third bodies in the multi-joint fish robot capable of the rapid acceleration propulsion of FIG. 5, and FIG. 10 is a view of showing chamfered edges of second and third bodies in the multi-joint fish robot capable of the rapid acceleration propulsion of FIG. 6.

Referring to FIG. 1 to FIG. 10, the multi-joint fish robot 1 capable of the rapid acceleration propulsion includes a main body 100 segmented into a first body 110, a second body 120 and a third body 130; and joints 200 connecting the bodies; and a caudal fin 300 provided at an end portion of the third body 130, and refers to a fish robot that swims forming a curve by operations of the joint 200, which is characterized in making length ratios of parts of the fish robot 1 be set within a predetermined range and thus improving the swimming speed of the fish robot 1.

In this exemplary embodiment, the fish robot 1 has a first occupancy ratio of a length L4 of the caudal fin 300 to a full length L of the fish robot 1 with respect to a swimming direction H, in which the fish robot 1 swims, as shown in in FIG. 1 or FIG. 3, and the first occupancy ratio ranges from 0.15 to 0.35.

The fish robot 1 is propelled in the swimming direction H based on water resistance to leftward and rightward movement of the caudal fin 300. Here, the first body (corresponding to the head of the fish robot) 110 moves in an opposite direction to the movement direction of the caudal fin 300 due to counteraction of the caudal fin 300.

At this time, if the left/right movement angle $\alpha$ of the first body 110 becomes greater, the straight directionality in the swimming direction H is deteriorated and the swimming speed is decreased by water resistance. The first body 110 serves as not only a keel mounted to a bottom of a boat and keeping a moving direction of a boat, but also a supporting point for withstanding a force exerted when the second body 120 and the third body 130 are turned left and right. If the left/right movement angle α of the first body 110 is greater than 25°, the propulsion in the swimming direction H is rapidly decreased.

In the fish robot 1, if the first occupancy ratio of the length L4 of the caudal fin 300 to the full length L of the fish robot 1 is higher than 0.35, the left/right movement angle α of the first body 110 is also greater than 25°. Therefore, it is preferable that the first occupancy ratio is equal to or lower than 0.35.

Nevertheless, if the first occupancy ratio is excessively lowered, the propulsion generated by the caudal fin 300 is decreased, thereby decreasing the swimming speed. Therefore, it is preferable that the first occupancy ratio is equal to or higher than 0.15.

Thus, the length ratio of the caudal fin 300 is set within a predetermined range so as to maximize the propulsion in the swimming direction and minimize water resistance, thereby improving the swimming speed and energy efficiency of the fish robot 1.

In the fish robot 1 according to this exemplary embodiment, the main body is segmented into a plurality of bodies, and the bodies are connected by the joints 200 in order to increase flexibility during the swimming. Referring to FIG. 2 and FIG. 3, the main body 100 includes the first body 110, the second body 120 and the third body 130, in which the first body 110 moves left and right at the left/right movement angle α to keep the straight directionality as the second body 120 and the third body 130 are moved left and right, the second body 120 moves at a first turning angle β with respect to the swimming direction H to thereby generate first propulsion, and the third body 130 moves at a second turning angle γ in the opposite direction to the movement direction of the second body 120 with respect to an axial direction of the second body 120 to thereby generate second propulsion. That is, the first propulsion, the second propulsion, and the propulsion generated in the caudal fin are combined all together to constitute the propulsion of the fish robot 1.

If the length L2 of the second body 120 is equal to the length L3 of the third body 130 and the first turning angle β is equal to the second turning angle γ, a widthwise component force F2 exerted when the second body 120 pushes water and a widthwise component force F3 exerted when the third body 130 pushes water are offset since they are the same and opposite to each other, thereby having no effects on the left/right movement angle α of the first body 110. Therefore, it is possible to prevent the left/right movement angle α of the first body from becoming greater, and thus prevent the propulsion of the fish robot 1 from being decreased.

Like this, it is most effective when the length L2 of the second body 120 is equal to the length L3 of the third body 130. However, if the length L2 of the second body 120 is different from the length L3 of the third body 130, it is advantageous when the length L2 of the second body 120 is longer than the length L3 of the second body 130.

If the length L3 of the second body 130 is longer than the length L2 of the second body 120, a position at which the widthwise component force F3 is exerted when the third body 130 pushes water is more distant from the first body 110 than a position at which the widthwise component force F2 is exerted when the second body 120 pushes water. As a position at which a residual component force caused by combining the two component forces is exerted becomes more distant from the first body 110, load (or moment) applied to the joints 200 coupled to the first body 110 increases. Therefore, the lifespan of the joint 200 becomes shorter.

It is not preferable when the length L2 of the second body 120 is longer twice or more than the length L3 of the second body 130. The reason is because the residual component force becomes greater and has an effect on the left/right movement angle α of the first body 110, thereby lowering the swimming speed and energy efficiency of the fish robot 1. Therefore, a ratio of the length of the second body 120 to the length Lb of a rear half body occupied by the second body 120 and the third body 130, i.e. a third occupancy ratio is designed to have a range of 0.5~0.75.

By the way, to minimize water resistance upon the fish robot 1 during the swimming, a cross-sectional width of each body may be configured as follows. Referring to FIG. 4 to FIG. 6, with respect to a widthwise direction perpendicular to the swimming direction H, a first cross-sectional ratio of a cross-sectional width d1 of the first body 110 to a first cross-sectional width d2a of the second body 120 facing the first body 110 may be designed to have a range from 0.9 to 1.25, and a second cross-sectional ratio of a second cross-sectional width d2b of the second body 120 to the cross-sectional width d3 of the third body 130 facing the second body 120 may be designed to have a range from 0.9 to 1.25.

As shown in FIG. 5, if the first cross-sectional width d2a of the second body 120 is very larger than the cross-sectional width d1 of the first body 110 and the cross-sectional width d3 of the third body 130 is very larger than the second cross-sectional width d2b of the second body 120, that is, if the first and second cross-sectional ratios are smaller than 1, water flowing along the outer surface of the fish robot 1 hits a protrusion 121 of the second body 120 and a protrusion 131 of the third body 130. Therefore, the fish robot 1 primarily meets with water resistance and secondarily meets with resistance of vortexes caused by water flowing backward. In particular, the resistance upon the fish robot 1 increases rapidly when the first and second cross-sectional ratios are smaller than 0.9, and it is therefore preferable that the first and second cross-sectional ratios are equal to or greater than 0.9.

As shown in FIG. 6, if the first cross-sectional width d2a of the second body 120 is very smaller than the cross-sectional width d1 of the first body 110 and the cross-sectional width d3 of the third body 130 is very smaller than the second cross-sectional width d2b of the second body 120, that is, if the first and second cross-sectional ratios are greater than 1, the fish robot 1 meets with resistance of vortexes caused by change in direction of water flow. In particular, the vortex resistance upon the fish robot 1 increases rapidly when the first and second cross-sectional ratios are greater than 1.25, and it is therefore preferable that the first and second cross-sectional ratios are equal to or lower than 1.25.

Here, the bodies are spaced apart at a predetermined distance from each other so as to smooth left and right turning movements. As shown in FIG. 7, the first body 110 and the second body 120 are spaced apart from each other by a first distance R1, and the second body 120 and the third body 130 are spaced apart from each other by a second distance R2. Therefore, water flowing along the outer surface of the fish robot 1 flows into and comes out of the spaces between the bodies, thereby causing vortexes. This vortex is another reason of lowering the propulsion of the fish robot 1.

To reduce the vortexes, as shown in FIG. 8, the cross-sectional edges of the second body 120 facing the first body 110 may be chamfered or rounded (not shown), and the cross-sectional edges of the third body 130 facing the second body 120 may be chamfered or rounded (not shown).

Accordingly, as shown in FIG. 9 and FIG. 10, a first chamfered area A1 is formed at the cross-sectional edge of the second body 120. In light of reducing the vortexes, a first stepped distance W1 between a first slope starting point P1 where the cross-section of the second body 120 meets with the first chamfered area A1 and a virtual first intersection line C1 where the cross-section of the second body 120 is extended and meets with the outer surface of the second body 120 may be equal to or longer than a first distance R1, and an angle θ1 of the first chamfered area A1 with respect to the swimming direction H may range from 25° to 45°.

Likewise, a second chamfered area A2 is formed at the cross-sectional edge of the third body 130. In light of reducing the vortexes, a second stepped distance W2 between a second slope starting point P2 where the cross-section of the third body 130 meets with the second chamfered area A2 and a virtual second intersection line C2 where the cross-section of the third body 130 is extended and meets with the outer surface of the third body 130 may be equal to or longer than a second distance R2, and an angle θ2 of the second chamfered area A2 with respect to the swimming direction H may range from 25° to 45°.

At this time, as shown in FIG. 9 or FIG. 10, it is advantageous that the first stepped distance W1 is twice the first distance R1 if the cross-sectional width d1 of the first body 110 is smaller than the first cross-sectional width d2a of the second body 120, and the first stepped distance W1 is equal to the first distance R1 if the cross-sectional width d1 of the first body 110 is larger than the first cross-sectional width d2a of the second body 120 facing the first body 110. Further, it is advantageous that the second stepped distance W2 is twice the second distance R2 if the second cross-sectional width d2b of the second body 120 is smaller than the cross-sectional width d3 of the third body 130, and the second stepped distance W2 is equal to the second distance R2 if the second cross-sectional width d2b of the second body 120 is larger than the cross-sectional width d3 of the third body 130 facing the other side of the second body 120.

As shown in FIG. 9, if the cross-sectional width d1 of the first body 110 is smaller than the first cross-sectional width d2a of the second body 120 or if the second cross-sectional width d2b of the second body 120 is smaller than the cross-sectional width d3 of the third body 130, the fish robot 1 primarily meets with resistance since water flowing along the outer surface of the fish robot 1 hits the protrusion 121 of the second body 120 and the protrusion 131 of the third body 130. That is, if the protrusions 121 and 131 of blocking the flow of water are present on the outer surface of the fish robot 1, the water resistance is minimized by relatively increasing the first and second stepped distances W1 and W2.

Below, a multi-joint fish robot 2 capable of rapid acceleration propulsion according to another embodiment of the present invention will be described, in which like numerals refer to like elements between the multi-joint fish robot 1 and the multi-joint fish robot 2 and repetitive descriptions will be avoided.

Figure 11:
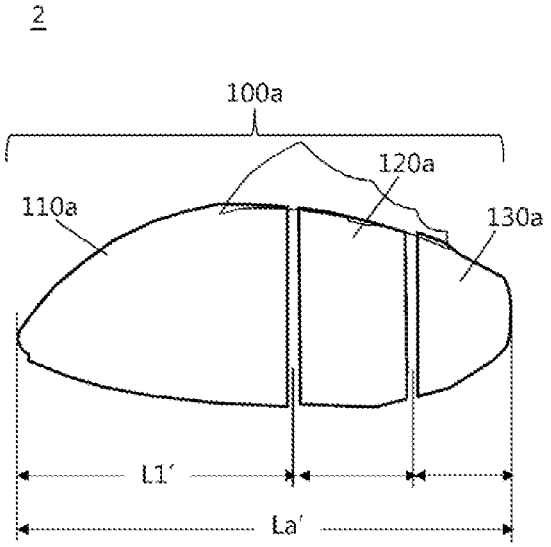
FIG. 11 is a lateral view of a multi-joint fish robot capable of rapid acceleration propulsion according to another embodiment of the present invention.
Figure 12:
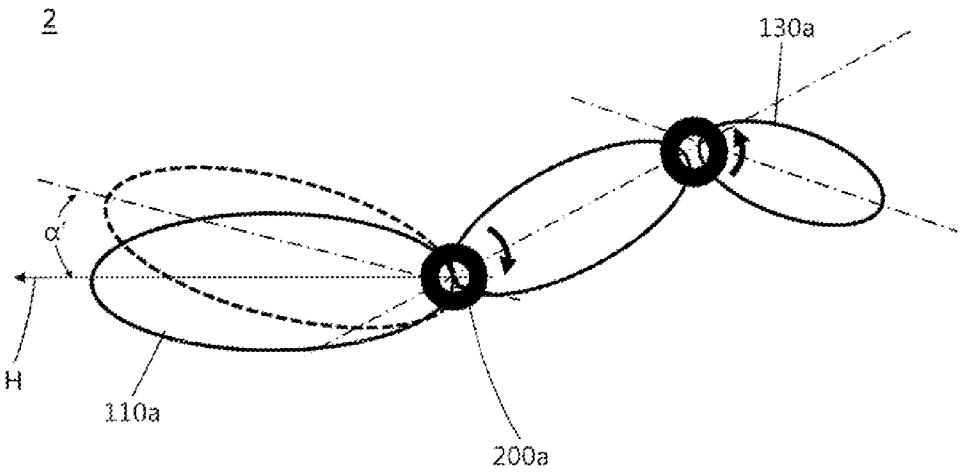
FIG. 12 is a view for explaining a principle of generating the propulsion in the multi-joint fish robot capable of the rapid acceleration propulsion of FIG. 11.

FIG. 11 is a lateral view of a multi-joint fish robot capable of rapid acceleration propulsion according to another embodiment of the present invention, and FIG. 12 is a view for explaining a principle of generating the propulsion in the multi-joint fish robot capable of the rapid acceleration propulsion of FIG. 11.

The embodiment shown in FIG. 11 and the embodiment shown in FIG. 1 are different in whether a caudal fin is taken into account while determining an occupancy ratio of the first body. In accordance with the kinds of fish, the caudal fin is very small, or the caudal fin is very long and big but too soft to have an effect on propulsion.

When the fish robot is designed by copying such a fish, as shown in FIG. 11 or FIG. 12, an occupancy ratio of a first body 110*a* may be determined with respect to a length of a main body 100*a* while ignoring the caudal fin.

Therefore, the fish robot 2 according to this embodiment of the present invention includes a main body 100*a* segmented into a first body 110*a*, a second body 120*a* and a third body 130*a*; and joints 200*a* connecting the bodies, and refers to a fish robot 2 that swims forming a curve by operations of the joint 200*a*, which is characterized in that the fish robot 2 has a second occupancy ratio of a length L1' of the first body 110*a* to a length La' of the main body 100*a* with respect to a swimming direction H, in which the fish robot 2 swims, and the second occupancy ratio ranges from 0.45 to 0.75.

As shown in FIG. 12, the fish robot 2 is propelled in the swimming direction H based on water resistance to leftward and rightward movement of the third body 130*a*. Here, the first body 110*a* moves in an opposite direction to the movement direction of the third body 130*a* due to counter-action of the third body 130*a* of the first body 110*a*.

At this time, if the left/right movement angle α' of the first body 110*a* becomes greater, the straight directionality in the swimming direction H is deteriorated and the swimming speed is decreased by water resistance. If the left/right movement angle α of the first body 110*a* is greater than 45°, the propulsion in the swimming direction H is rapidly decreased.

If the second occupancy ratio of the length L1' of the first body 110*a* to the length La' of the main body 100*a* is greater than 0.75, the left/right movement angle α' of the first body 110*a* is also greater than 45°. Therefore, it is preferable that the second occupancy ratio is equal to or lower than 0.75.

On the other hand, if the second occupancy ratio is excessively lowered, the propulsion generated by the third body 130*a* is decreased, thereby decreasing the swimming speed. Therefore, it is preferable that the second occupancy ratio is equal to or higher than 0.45

Thus, the length ratio of the third body 130*a* is set within a predetermined range so as to maximize the propulsion in the swimming direction and minimize water resistance, thereby improving the swimming speed and energy efficiency of the fish robot 2.

In addition, this embodiment may have the same technical features as the foregoing embodiment (e.g. the limitations to the occupancy ratio of the second body, the cross-sectional width of each body, the cross-sectional edge of each body, etc.), and thus have various corresponding effects.

As described above, the multi-joint fish robot capable of the rapid acceleration propulsion according to the present invention maximizes the propulsion in the swimming direction and minimizes the water resistance by setting the ratio of the length of the caudal fin to the full length of the fish robot within a predetermined range, and thus improves the swimming speed and energy efficiency of the fish robot.

Further, the multi-joint fish robot capable of the rapid acceleration propulsion according to the present invention prevents the propulsion of the robot from being decreased by setting the ratio of the length of the second body to the rear half body occupied by the second body and the third body within a predetermined range, and thus has an effect on preventing the lifespan of the joints from being shortened.

Further, the multi-joint fish robot capable of the rapid acceleration propulsion according to the present invention has an effect on reducing water resistance by setting the ratio of the cross-sectional width of each body of the fish robot within a predetermined range, Further, the multi-joint fish robot capable of the rapid acceleration propulsion according to the present invention has an effect on reducing vortexes by chamfering or rounding the cross-sectional edge of each body in the fish robot.

Further, the multi-joint fish robot capable of the rapid acceleration propulsion according to the present invention has an effect on reducing the vortexes and minimizing the water resistance by setting an angle of a chamfered area formed on each body within a predetermined range and adjusting a stepped distance of the chamfered area in accordance with the cross-section ratios.

Further, the multi-joint fish robot capable of the rapid acceleration propulsion according to the present invention maximizes the propulsion in the swimming direction and minimizes the water resistance by setting the ratio of the length of the first body to the length of the main body in the fish robot, and thus has an effect on improving the swimming speed and energy efficiency of the fish robot.

In the multi-joint fish robot capable of the rapid acceleration propulsion according to the present invention, it is possible to minimize water resistance by maximizing the propulsion of the fish robot, and thus improve the swimming speed and energy efficiency of the fish robot.

Further, in the multi-joint fish robot capable of the rapid acceleration propulsion according to the present invention, it is possible to prevent the propulsion of the robot from being decreased by setting the ratio of the length of the second body to the length of the rear half body occupied by the second body and the third body within a predetermined range, and prevent the lifespan of the joint from being shortened.

Further, in the multi-joint fish robot capable of the rapid acceleration propulsion according to the present invention, it is possible to decrease the water resistance by setting the cross-sectional width ratio of each body in the fish robot.

Further, in the multi-joint fish robot capable of the rapid acceleration propulsion according to the present invention, it is possible to reduce the vortexes by chamfering or rounding the cross-sectional edge of each body in the fish robot.

Further, in the multi-joint fish robot capable of the rapid acceleration propulsion according to the present invention, it is possible to reduce the vortexes and minimize the water resistance by setting an angle of a chamfered area formed on each body within a predetermined range and adjusting a stepped distance of the chamfered area in accordance with the cross-section ratios.

Although a few exemplary embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A multi-joint fish robot comprising:

a main body segmented into a first body, a second body and a third body;

joints connecting the respective bodies; and a caudal fin provided at an end portion of the third body, and swims forming a curve by operations of the joints, wherein the fish robot has a first occupancy ratio of a length of the caudal fin to a full length of the fish robot with respect to a swimming direction, in which the fish robot swims, and the first occupancy ratio ranges from 0.15 to 0.35, and wherein the first body and the second body are spaced apart from each other by a first distance, and an edge of a first cross-section of the second body facing the first body is chamfered or rounded.

2. The multi-joint fish robot according to claim 1, wherein a third occupancy ratio of a length of the second body to a length of a rear half body occupied by the second body and the third body ranges from 0.5 to 0.75.

3. The multi-joint fish robot according to claim 1, wherein a first cross-sectional ratio of a cross-sectional width of the first body to a first cross-sectional width of the second body facing a cross-section of the first body with respect to a widthwise direction perpendicular to the swimming direction ranges from 0.9 to 1.25.

4. The multi-joint fish robot according to claim 1, wherein a second cross-sectional ratio of a second cross-sectional width of the second body to a cross-sectional width of the third body facing a second cross-section of the second body with respect to a widthwise direction perpendicular to the swimming direction ranges from 0.9 to 1.25.

5. The multi-joint fish robot according to claim 1, wherein the edge of the cross-section of the second body is formed with a first chamfered area, a first stepped distance between a first slope starting point at which the cross-section of the second body meets with the first chamfered area and a virtual first intersection line on which the cross-section of the second body is extended and meets with an outer surface of the second body is equal to or longer than the first distance, and an angle of the first chamfered area to the swimming direction ranges from 25° to 45°.

6. The multi-joint fish robot according to claim 5, wherein if the cross-sectional width of the first body is larger than the first cross-sectional width of the second body facing the first body, the first stepped distance is equal to the first distance, and if the cross-sectional width of the first body is smaller than the first cross-sectional width of the second body, the first stepped distance is twice the first distance.

7. The multi-joint fish robot according to claim 1, wherein the second body and the third body are spaced apart from each other by a second distance, and an edge of a cross-section of the third body facing the second body is chamfered or rounded.

8. The multi-joint fish robot according to claim 7, wherein the edge of the cross-section of the third body is formed with a second chamfered area, a second stepped distance between a second slope starting point at which the cross-section of the third body meets with the second chamfered area and a virtual second intersection line on which the cross-section of the third body is extended and meets with an outer surface of the third body is equal to or longer than the second distance, and an angle of the first chamfered area to the swimming direction ranges from 25° to 45°.

9. The multi-joint fish robot according to claim 8, wherein if a second cross-sectional width of the second body is larger than the cross-sectional width of the third body facing a second cross-section of the second body, the second stepped distance is equal to the second distance, and if the second cross-sectional width of the second body is smaller than the cross-sectional width of the third body, the second stepped distance is twice the second distance.

10. A multi joint fish robot comprising:

a main body segmented into a first body, a second body and a third body; and joints connecting the respective bodies, and swims forming a curve by operations of the joints, wherein the fish robot has a second occupancy ratio of a length of the first body to a length of the main body with respect to a swimming direction, in which the fish robot swims, and the second occupancy ratio ranges from 0.45 to 0.75, and wherein the first body and the second body are spaced apart from each other by a first distance, and an edge of a first cross-section of the second body facing the first body is chamfered or rounded.

11. The multi-joint fish robot according to claim 10, wherein a third occupancy ratio of a length of the second body to a length of a rear half body occupied by the second body and the third body ranges from 0.5 to 0.75.

12. The multi-joint fish robot according to claim 10, wherein a first cross-sectional ratio of a cross-sectional width of the first body to a first cross-sectional width of the second body facing a cross-section of the first body with respect to a widthwise direction perpendicular to the swimming direction ranges from 0.9 to 1.25.

13. The multi-joint fish robot according to claim 10, wherein a second cross-sectional ratio of a second cross-sectional width of the second body to a cross-sectional width of the third body facing a second cross-section of the second body with respect to a widthwise direction perpendicular to the swimming direction ranges from 0.9 to 1.25.

14. The multi-joint fish robot according to claim 10, wherein the edge of the cross-section of the second body is formed with a first chamfered area, a first stepped distance between a first slope starting point at which the cross-section of the second body meets with the first chamfered area and a virtual first intersection line on which the cross-section of the second body is extended and meets with an outer surface of the second body is equal to or longer than the first distance, and an angle of the first chamfered area to the swimming direction ranges from 25° to 45°.

15. The multi-joint fish robot according to claim 14, wherein if the cross-sectional width of the first body is larger than the first cross-sectional width of the second body facing the first body, the first stepped distance is equal to the first distance, and if the cross-sectional width of the first body is smaller than the first cross-sectional width of the second body, the first stepped distance is twice the first distance.

16. The multi-joint fish robot according to claim 10, wherein the second body and the third body are spaced apart from each other by a second distance, and an edge of a cross-section of the third body facing the second body is chamfered or rounded.

17. The multi-joint fish robot according to claim 16, wherein the edge of the cross-section of the third body is formed with a second chamfered area, a second stepped distance between a second slope starting point at which the cross-section of the third body meets with the second chamfered area and a virtual second intersection line on which the cross-section of the third body is extended and meets with an outer surface of the third body is equal to or longer than the second distance, and an angle of the first chamfered area to the swimming direction ranges from 25° to 45°.

18. The multi-joint fish robot according to claim 17, wherein if a second cross-sectional width of the second body is larger than the cross-sectional width of the third body facing a second cross-section of the second body, the second stepped distance is equal to the second distance, and if the second cross-sectional width of the second body is smaller than the cross-sectional width of the third body, the second stepped distance is twice the second distance.

* * * * *